US008313168B2

(12) United States Patent
Norasak et al.

(10) Patent No.: US 8,313,168 B2
(45) Date of Patent: Nov. 20, 2012

(54) WIND BAFFLES FOR MICRO-FLUID EJECTION DEVICES

(75) Inventors: Sam Norasak, Lexington, KY (US); Adam Neal Chalin, Lexington, KY (US); David Weatherly, Versailles, KY (US); Eric Spenser Hall, Lexington, KY (US); Shirish Mulay, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 271 days.

(21) Appl. No.: 12/775,530

(22) Filed: May 7, 2010

(65) Prior Publication Data

US 2011/0273513 A1 Nov. 10, 2011

(51) Int. Cl.
*B41J 2/135* (2006.01)

(52) U.S. Cl. ..... 347/44; 347/37; 347/67

(58) Field of Classification Search ..... 347/29, 347/32–34, 37, 67, 77, 101–102
See application file for complete search history.

(56) References Cited

U.S. PATENT DOCUMENTS

| | | | | |
|---|---|---|---|---|
| 6,886,905 | B2 | 5/2005 | McElfresh et al. | |
| 6,997,538 | B1 | 2/2006 | Kawamura et al. | |
| 2010/0156988 | A1 * | 6/2010 | Kimura et al. | 347/40 |

* cited by examiner

*Primary Examiner* — Thinh Nguyen

(57) ABSTRACT

A micro-fluid ejection device defines a print gap from an ejection head to a print media. An ejection zone of the head ejects fluid across the print gap during use. At least one wind baffle adjacent the ejection zone modifies airflow in the print gap as the head scans. In various designs, multiple wind baffles reside on either sides of the ejection zone to provide a cascading airflow effect from one wind baffle to the next. Baffle shapes, spacing and locations define multiple embodiments.

18 Claims, 10 Drawing Sheets

WIND BAFFLES FOR MICRO-FLUID EJECTION DEVICES

FIELD OF THE INVENTION

The present invention relates to micro-fluid ejection devices, such as printers, copiers, graphics plotters, all-in-ones, etc. More particularly, it relates to ejection heads, e.g., inkjet printheads, having wind baffles. The baffles modify airflow beneath an ejection zone where fluid crosses a print gap from the head to a print media.

BACKGROUND OF THE INVENTION

The art of printing images with micro-fluid technology is relatively well known. Conventionally, a permanent or semi-permanent ejection head has access to a local or remote supply of fluid. The fluid ejects from an ejection zone of the head to a print media in a pattern corresponding to pixels of images being printed. Over time, the heads and fluid drops have become increasingly smaller.

In the course of developing heads with fluid drop sizes smaller than 5 Pico liters, a "tree vein" or "wood grain" print defect has been observed. It consists of dark-toned bands meandering from outboard edges of a printing swath toward a center. The bands are typically present for most of the swath length except for a short portion near the beginning of fluid jetting. The bands have been also observed across any swath width so long as the fluid jetting nozzles are spaced relatively closely together. While reduction of the print gap from the ejection zone of the head to the print media tends to minimize or eliminate the defects, there is a lower practical limit to decreasing the gap. If it becomes too short, inadvertent contact with the media by the head will smear the yet-to-dry fluid.

In the print gap, air velocity varies approximately linearly between the scan speed at the ejection zone (e.g., nozzle plate) of the head and zero at the print medium. Simulation by the inventors has shown that a curtain of fluid drops from a closely spaced array of nozzles in an ejection zone is capable of strongly influencing the print gap airflow. The wakes of the drops effectively constitute a moving barrier that pushes out air as the head scans. The result is a flow field similar to a river flowing around a row of bridge pilings, in which the fluid velocity downstream meanders from side to side in irregularly shifting patterns. It is believed main drops from the head tend to travel to the print media with little deviation due to their large mass. The smaller satellite drops, on the other hand, are believed to slow down and become influenced in direction by the local airflow. The observed wood grain effect is consistent with this hypothesis, i.e., satellite drops are channeled together into concentrated bands by the print gap airflow as modified by the wakes of the main drops.

Simulations further show that the flow field around the head develops in both time and space. This effect occurs in the print gap also: the velocity profile changes with time and varies across the width of the ejection zone even when no fluid ejectors are jetting. The time-dependence of the no-jetting flow field likely contributes to the wood grain print defect by forcing and enhancing local velocity oscillations around the ejectors.

Accordingly, a need exists to minimize or eliminate printing defects, especially when utilizing small volume drops. The need further extends to modifying airflow in the print gap and to do so consistently across as much of the gap as possible. Additional benefits and alternatives are also sought when devising solutions.

SUMMARY OF THE INVENTION

The above-mentioned and other problems are minimized by utilizing wind baffles with micro-fluid ejection heads. Broadly, the baffles modify airflow in a print gap between the head and print media as the head scans. The concept introduces surface structures that tend to drag air in the print gap. They are shaped, spaced and located so that the air velocity approximates the scan speed of an ejection zone as it reciprocates over the print media. It is intended to develop airflow conditions as early and as uniformly as possible during the scanning of the head and as consistently as possible over an entirety of the gap. In various designs, multiple wind baffles provide a cascading airflow effect from one wind baffle to the next.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the present invention, methods and apparatus describe wind baffles for an ejection head for use in micro-fluid ejection devices.

Figure 1:
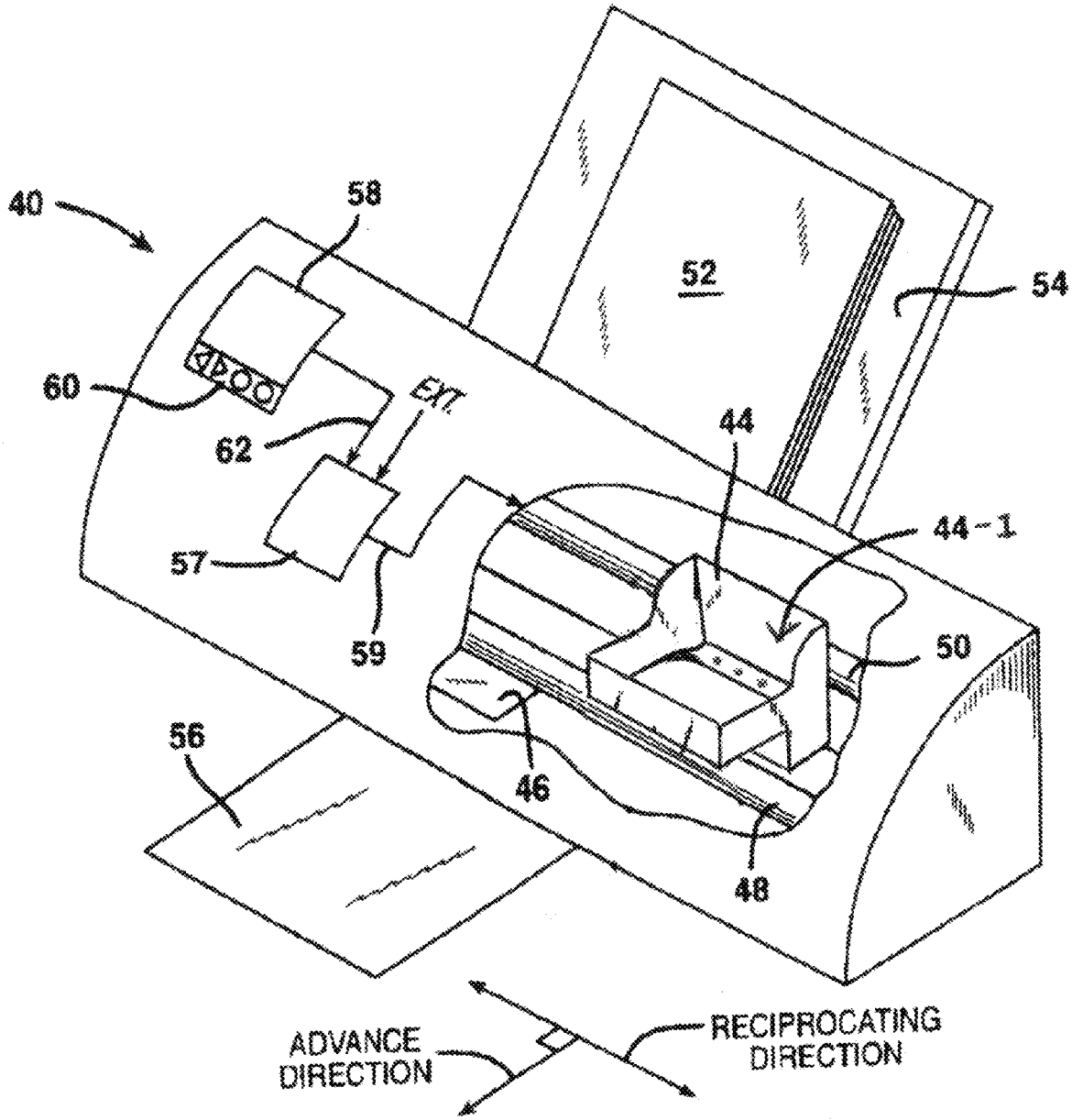
FIG. 1 is a perspective view in accordance with the present invention of an micro-fluid ejection device in the form of an inkjet printer having an ejection head.

With reference to FIG. 1, an ejection device in the form of an inkjet printer 40 contains an ejection head 44. The head has space 44-1 for a plurality of ink tanks that mate with septums to fluidly connect ink in the tank to the head. The head reciprocates bi-directionally in a scan direction according to an output 59 of a controller 57. It moves along a shaft 48 above a print zone 46 by a motive force supplied to a drive belt 50, as is known. The reciprocation occurs relative to a print medium, such as a sheet of paper 52, that advances in the printer along a paper path from an input 54 to output tray 56 via the print zone 46. While in the print zone, the head moves laterally in the direction indicated as Reciprocating. It is generally perpendicularly to the Advance Direction of the paper. Ink drops are caused to eject from the head at times pursuant to commands of the printer controller 57. The timing of the ink drop emissions corresponds to a pattern of pixels of the image being printed. Often times, the patterns are generated in devices electrically connected to the controller 57 (via Ext. input) that reside external to the printer. They include, but are not limited to, a computer, a scanner, a camera, a visual display unit, a personal data assistant, or other. A control panel 58, having user selection interface 60, also accompanies many printers as input 62 to the controller 57 to provide robustness.

Figure 2A:
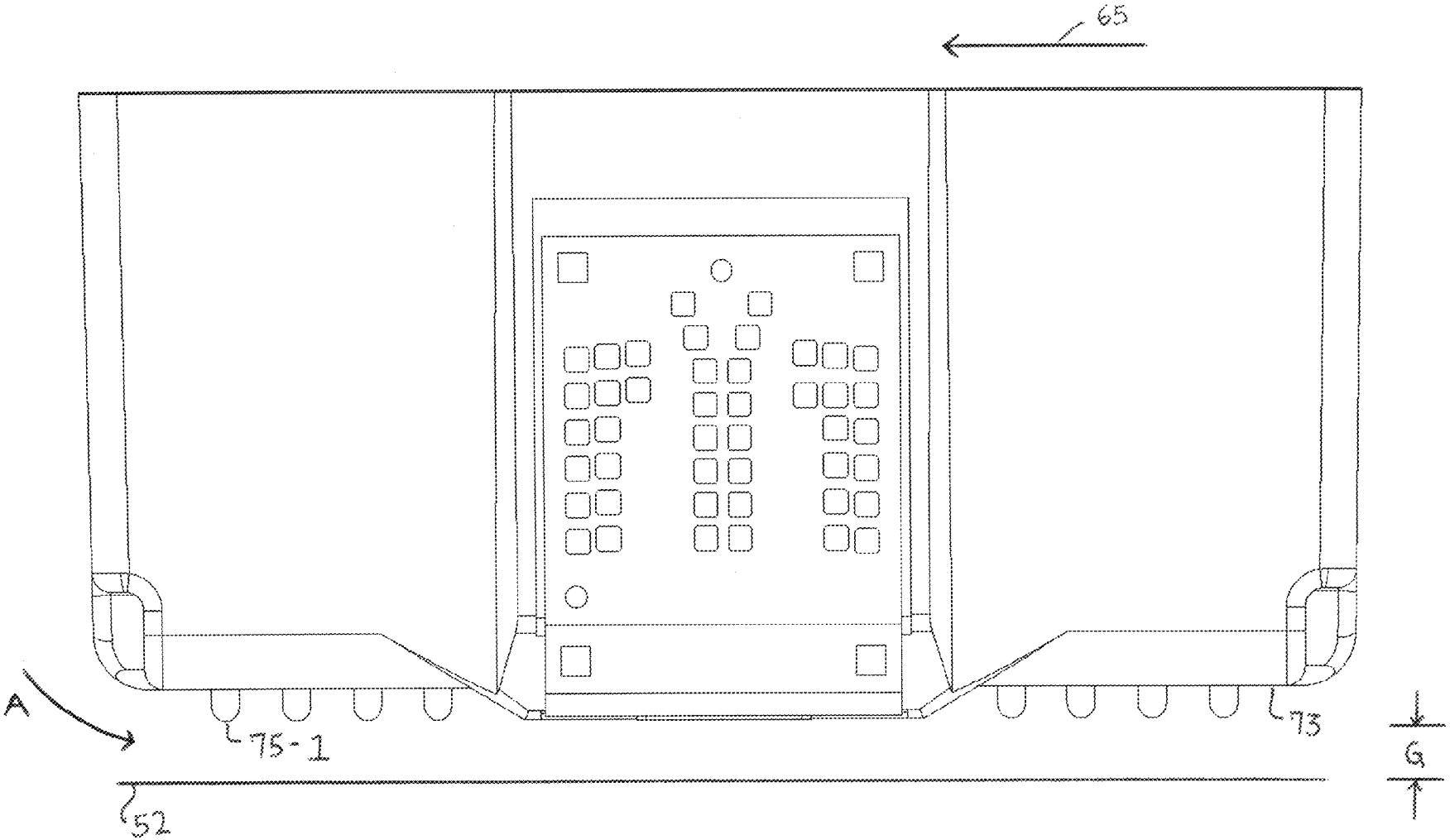
FIGS. 2A-2D are diagrammatic views in accordance with the present invention of an ejection head having wind baffles.
Figure 2B:
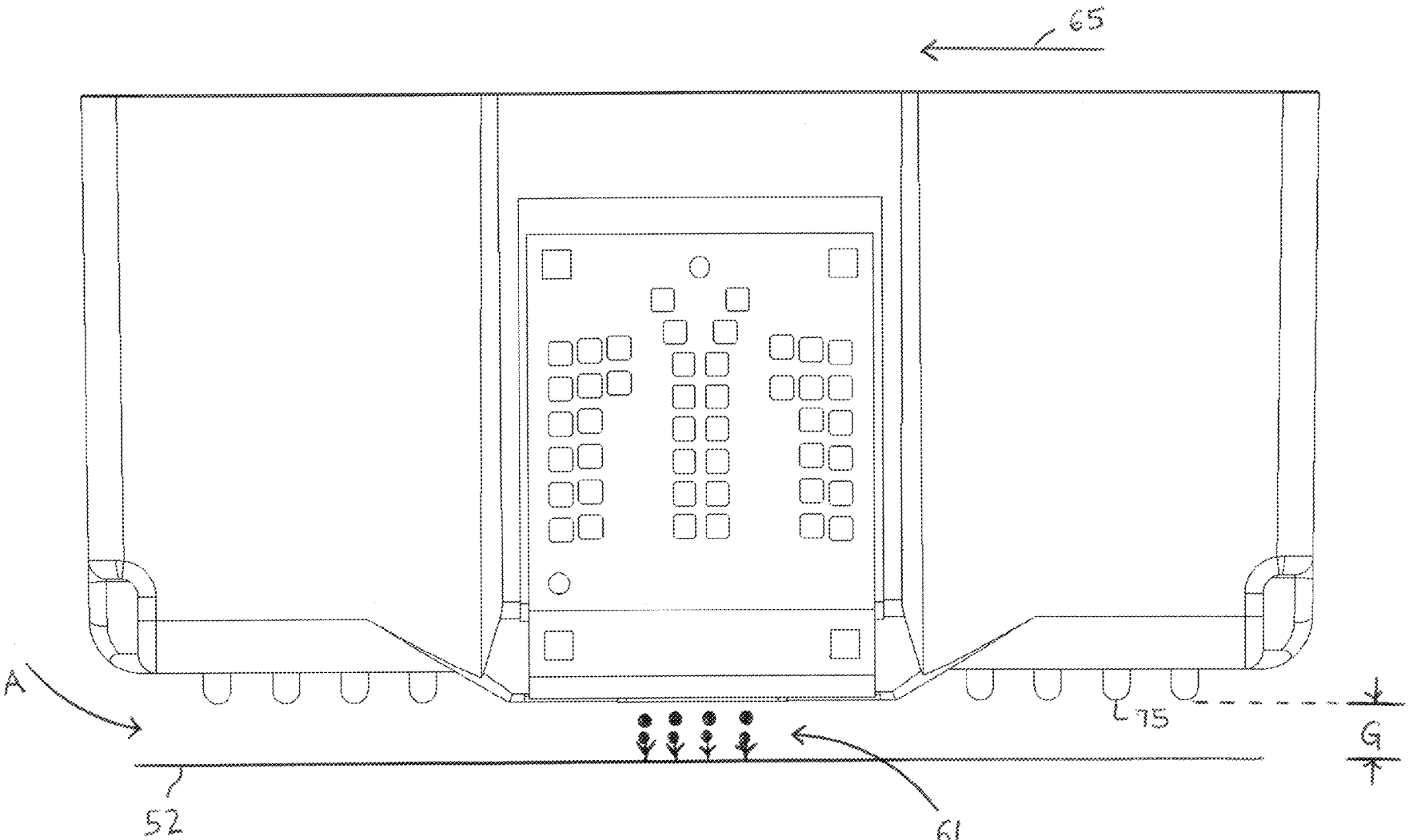
Figure 2C:
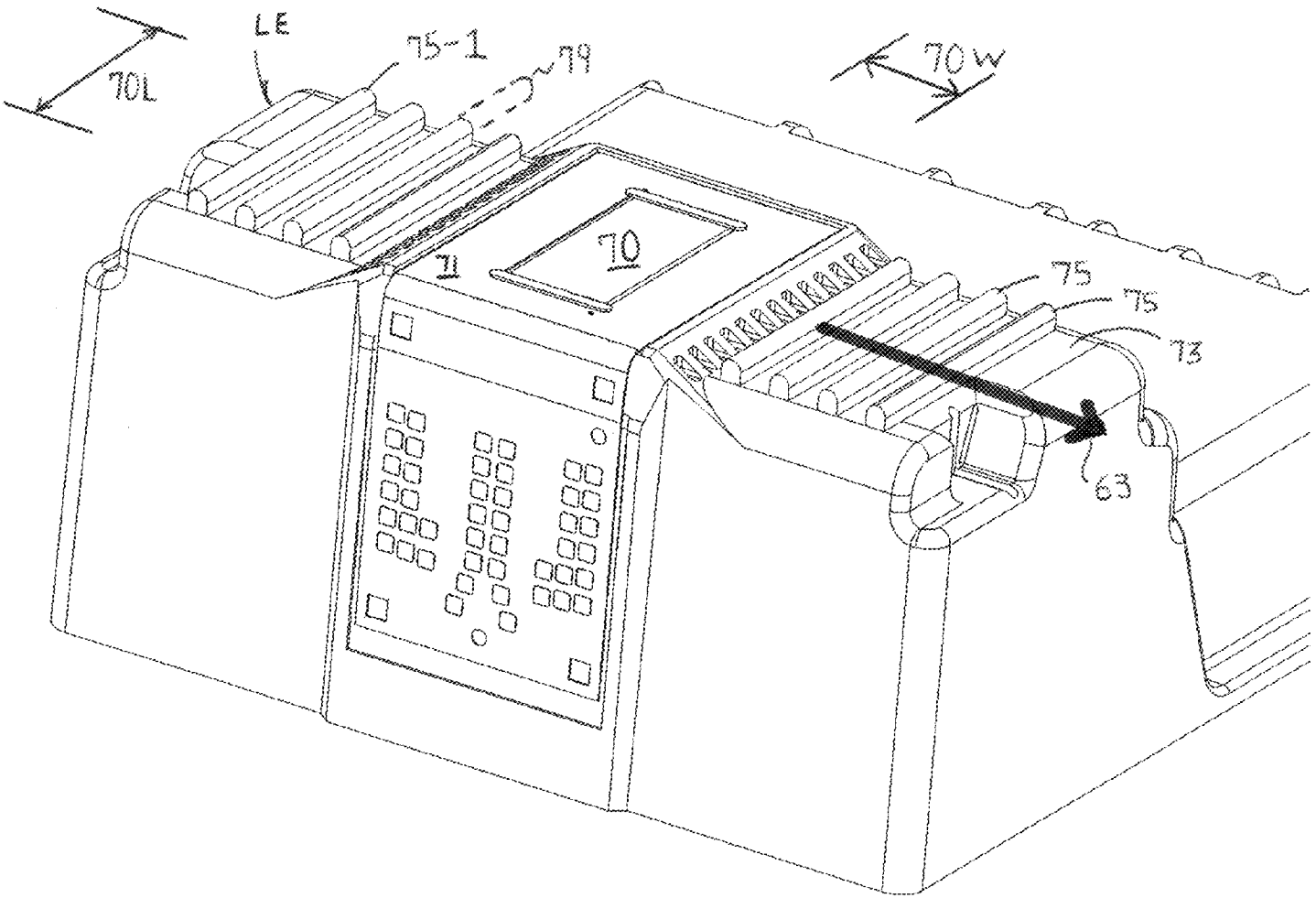
Figure 2D:
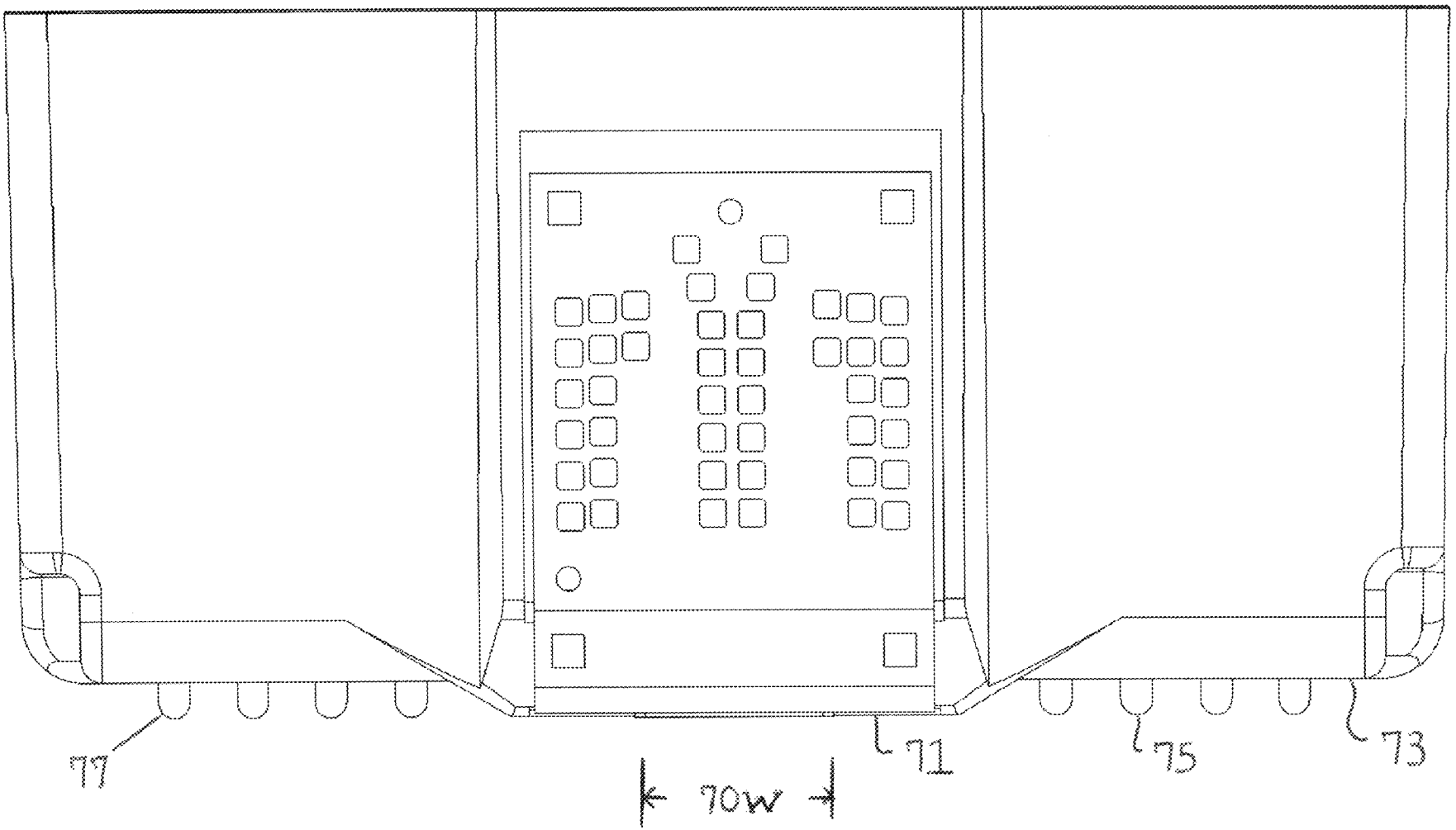

With reference to FIGS. 2A-2D, the head 44 is seen upright relative to a print media (paper 52) as it would operate during use and inverted to reveal its ejection zone 70 and wind baffles 75. The ejection zone includes pluralities of fluid ejecting orifices that define a substantially planar area (70 L×70 W). It is raised on an elevated surface 71, relative to a surface 73, in a direction toward the print gap G. It ejects fluid (ink drops 61) across the gap as seen in FIG. 2B.

Pluralities of baffles 75 extend toward the gap from the surface 73, but not into the gap. They also extend laterally over surface 73 beyond a periphery of the area defined by the ejection zone 70. Certain embodiments even contemplate extensions 79 of the baffles beyond the surface 73. In either, they run generally orthogonal to both the scan 65 and airflow directions 63 and reside fairly symmetrically on opposite sides of the ejection zone. They can number as few as one or as many as eight, or more. The location of a first baffle 75-1 is as close as possible to a leading edge (LE) of scanning movement, with others being evenly spaced and substantially parallel. Their shape can vary, but sloped leading surfaces 77 accommodate inrushing airflow and assist in deflecting paper upon inadvertent contact. Symmetrical shapes also serve to assist in modifying airflow as the head scans in opposite directions during sequential passes over a media. Representative cross sections include, but are not limited to, circles, tubes, triangles, domes, hemispheres, or the like.

Figure 3:
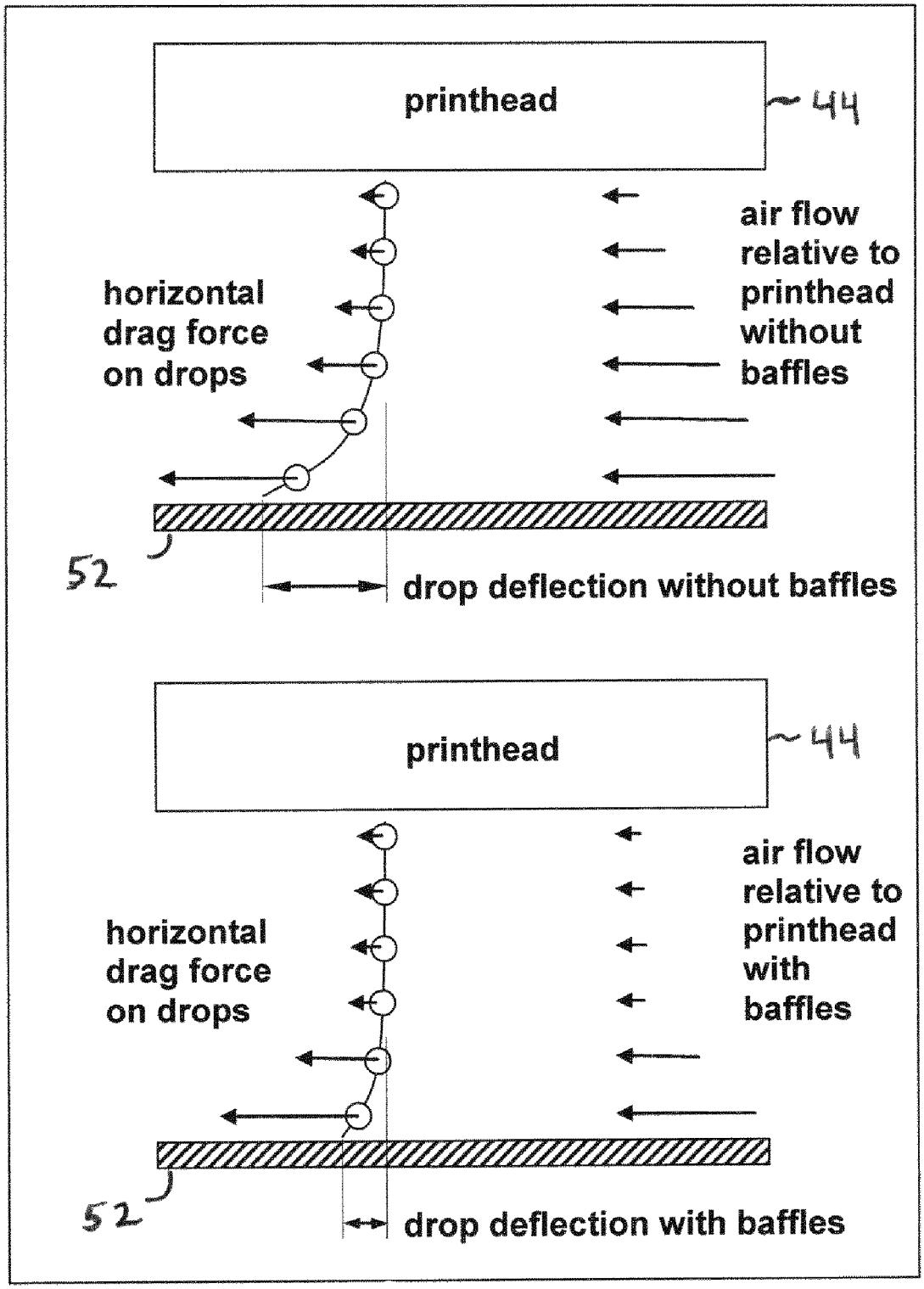
FIG. 3 is a diagrammatic view in accordance with the present invention illustrating relative drop deflection distances from ejection heads having baffles and those without baffles.

During use, air (A) rushes into the paper gap G as the head scans in the printhead movement direction 65. The baffles slow airflow velocity relative to the printhead. In the area beneath the ejection zone 70, airflow speed is caused to approximate the scan speed of the head as it moves past the media. In this manner, fluid drops are more consistently able to reach the media 52 without drifting. Print defects are minimized. In FIG. 3, relative "drop deflection" distances are seen from ejection heads with and without baffles according to simulations run by the inventors. With baffles, the airflow relative to the head is reduced over much of the print gap. As the relative airflow is reduced, both horizontal drag force and deflections decrease.

Figure 4A:
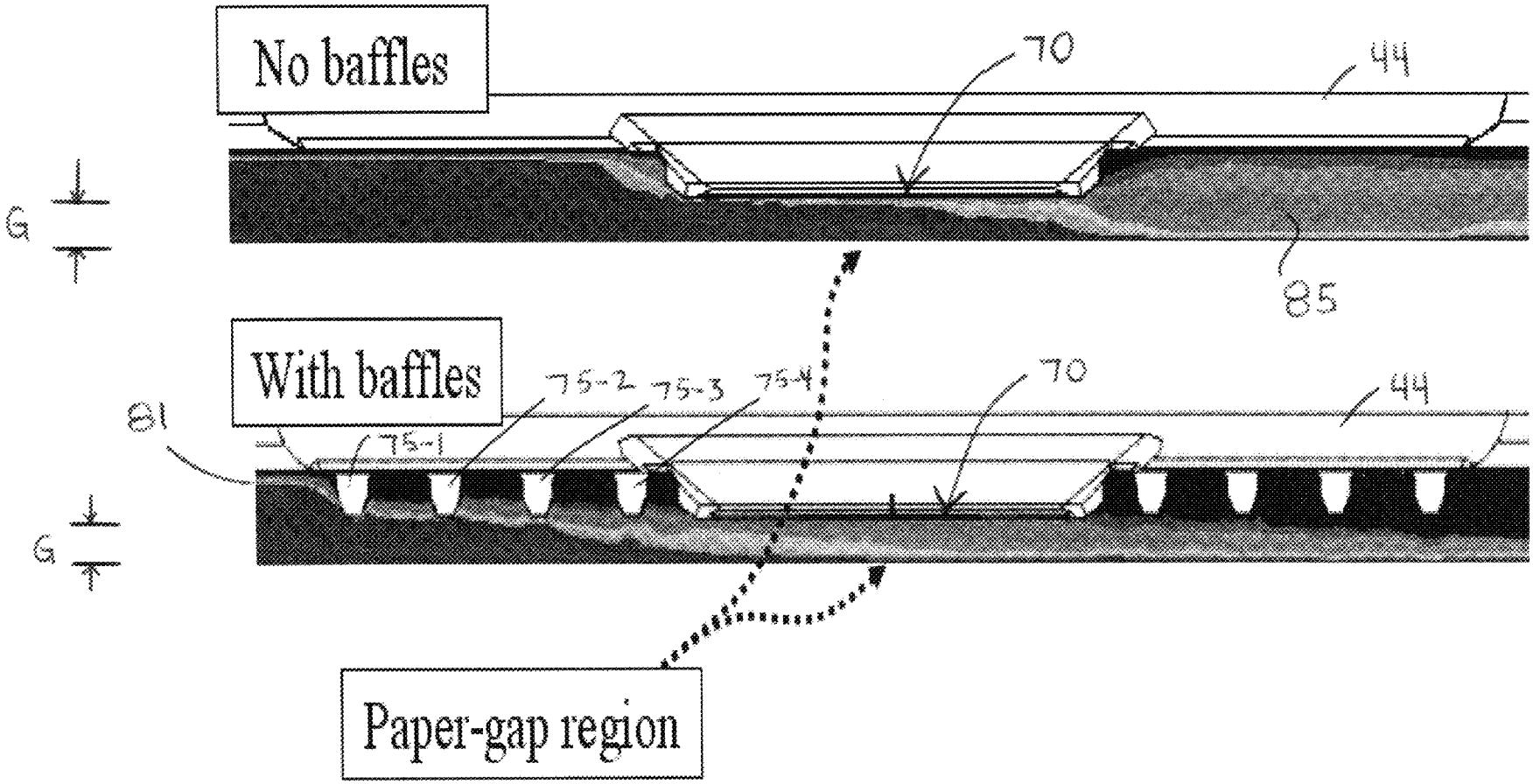
FIGS. 4A and 4B are diagrammatic views in accordance with the present invention illustrating airflow conditions in a print gap relative to ejection heads having baffles and those without baffles.
Figure 4B:
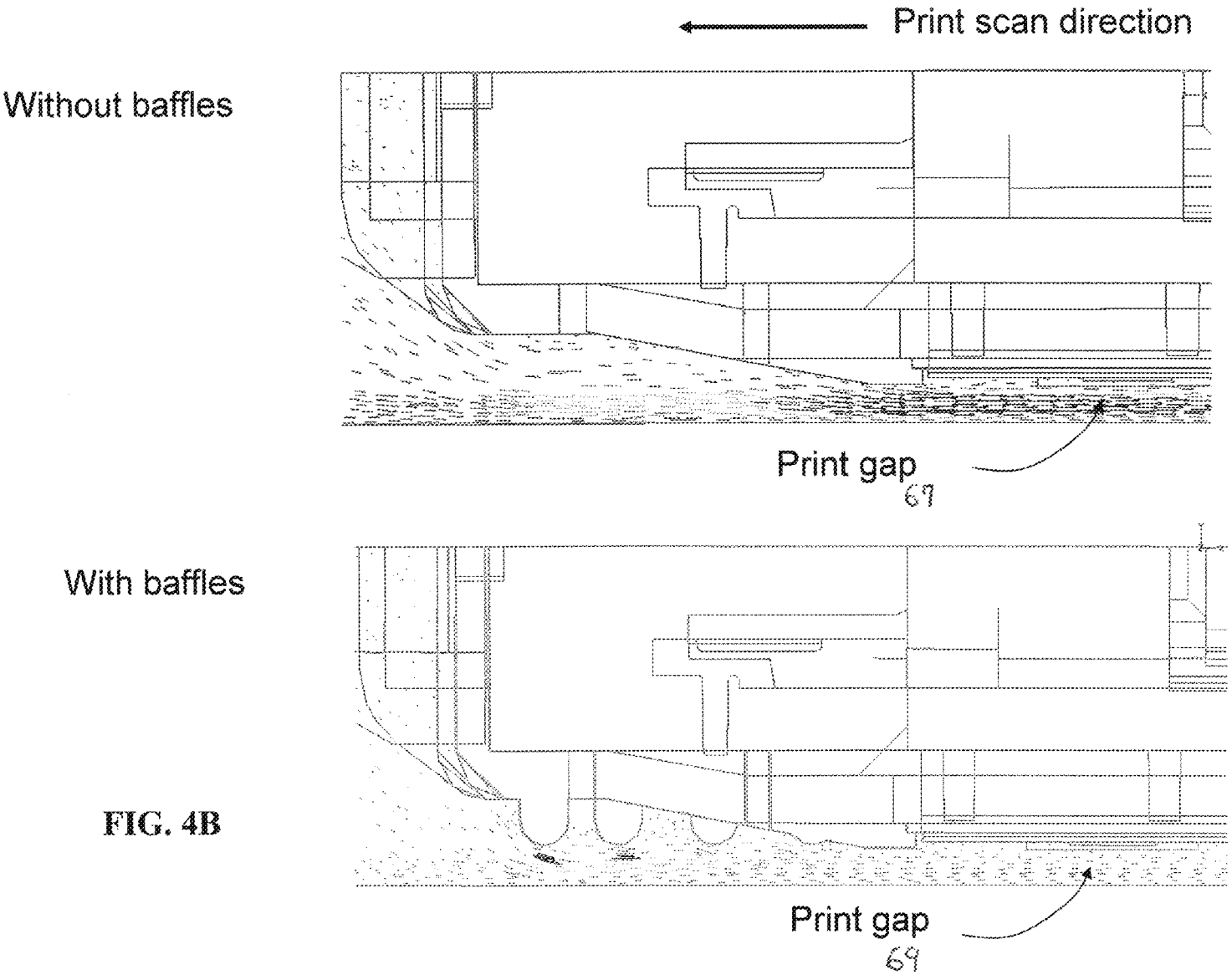

With reference to FIG. 4A, further simulations reveal a cascading airflow effect from one wind baffle to a next wind baffle as the head 44 reciprocates past the print media 52. As is evident, boundary conditions 81 encroach further into the gap G upon airflow impacting each successive baffle, e.g., from no baffle to the first baffle 75-1, from baffle 75-1 to 75-2, from 75-2 to 75-3, and from 75-3 to 75-4. The result is an optimized airflow underneath the ejection zone 70 of the head 44. Conversely, an optimized airflow in a design having "no baffles" is seen in a region 85 downstream of the ejection zone. The reason is that the elevated surface (e.g., mesa) of the ejection zone acts as a baffle for region 85, whereas a lack of baffles preceding the ejection zone is unable to obtain desired airflow effects underneath the ejection zone where fluid drops actually traverse the gap G. Similarly, FIG. 4B reveals simulated airflow velocities for heads configured with and without baffles. The velocity vectors in the print gap 67 are seen more bunched and of larger magnitude in comparison to those in the print gap 69.

Figure 5:
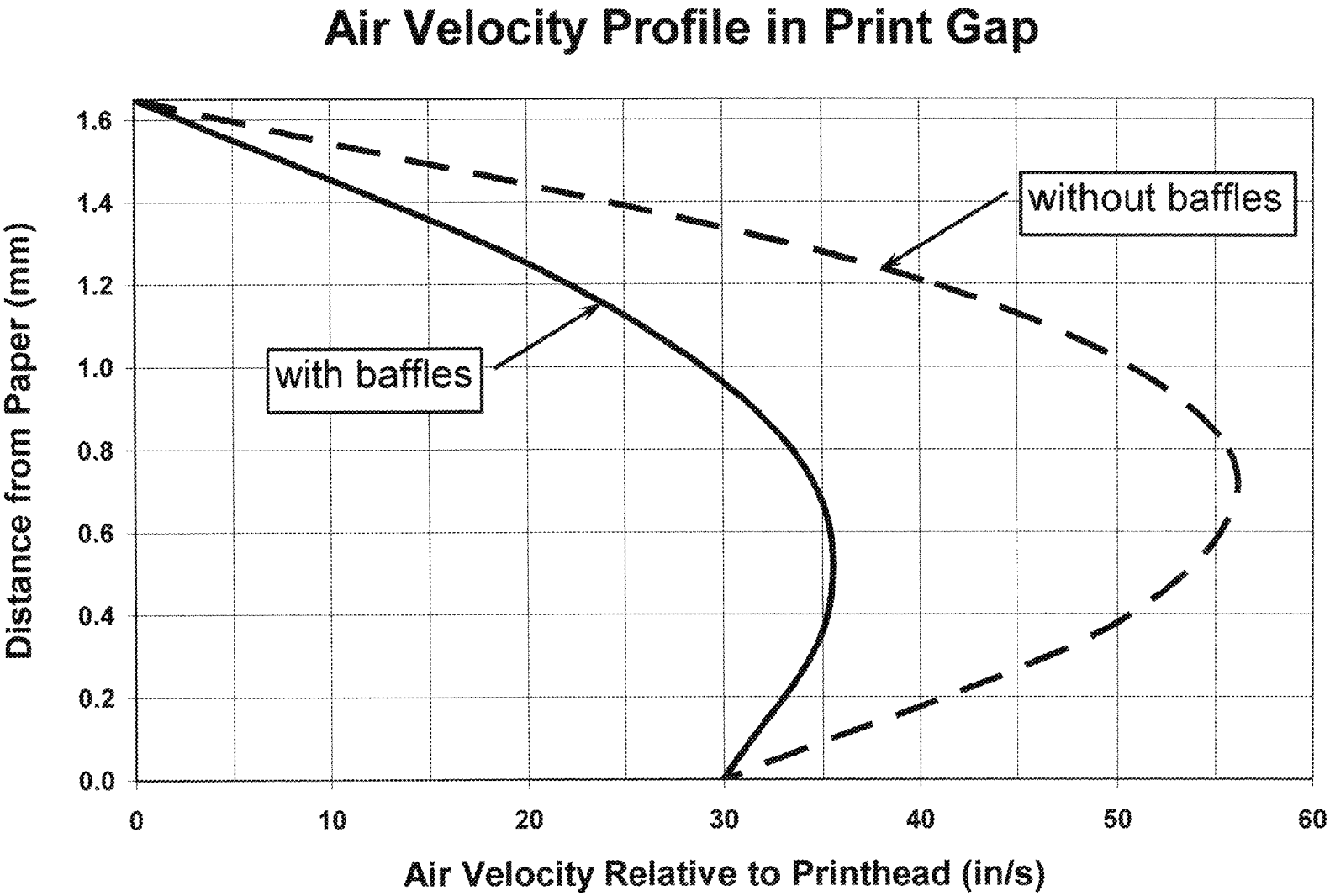
FIG. 5 is a graph in accordance with the present invention illustrating velocities in a print gap relative to ejection heads having baffles and those without baffles.

With reference to FIG. 5, still further simulations plot airflow velocity (x-axis) versus a distance of the paper gap (y-axis). As is seen, the design "with baffles" results in slower airflow for all gap distances in comparison to the curve representing "without baffles."

Figure 6:
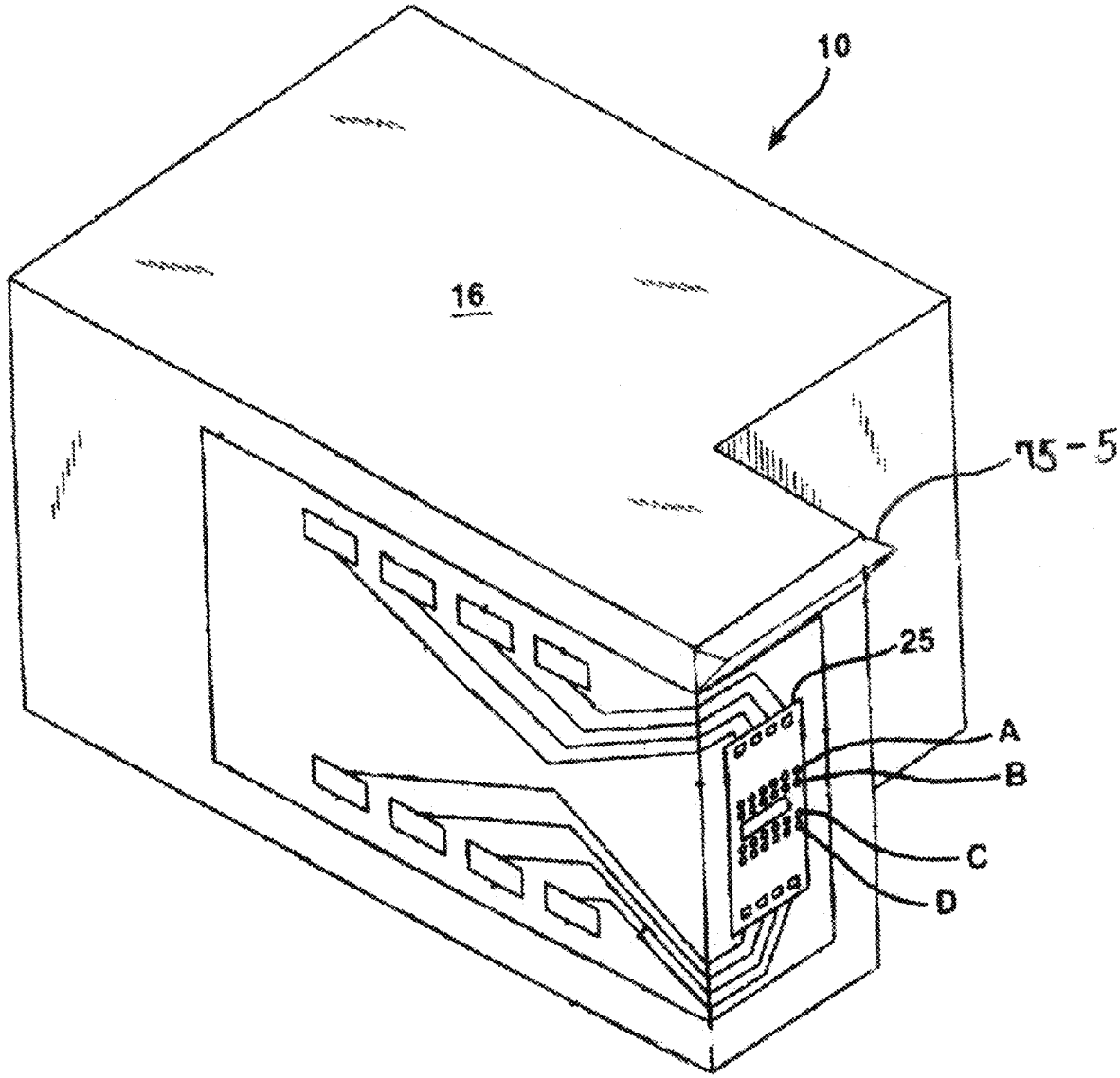
FIG. 6 is a perspective view in accordance with the present invention of an integrated ejection head having a wind baffle.

With reference to FIG. 6, skilled artisans will appreciate that further designs of micro-fluid ejection heads contemplate integrated printheads 10. They have a local supply of fluid in compartment 16 and a fluid ejecting chip 25. In such designs, an ejection zone defined by the area of circles in rows A, B, C, D can be preceded by an adjacent baffle 75-5. Alternatively, or in addition, the baffle could reside on a carriage in a micro-fluid ejection device, such as a printer, that carries the integrated printhead.

The foregoing has been presented for purposes of illustrating the various aspects of the invention. It is not intended to be exhaustive or to limit the claims. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims.

The invention claimed is:

1. A micro-fluid ejection head for a micro-fluid ejection device defining a print gap from the ejection head to a print media during use, comprising:

an ejection zone on the head that ejects fluid across the print gap during use; and at least one wind baffle adjacent the ejection zone to modify airflow in the print gap as the head scans across the print media, wherein the ejection zone defines an elevated area from a surface of the head, the at least one wind baffle having a height from the surface of the head to the elevated area and not encroaching in the print gap.

2. The ejection head of claim 1, wherein the ejection zone defines an area on a surface of the head, the at least one wind baffle having a first dimension in a direction orthogonal to a scan direction of the head extending beyond a boundary of the area.

3. The ejection head of claim 1, wherein the at least one wind baffle resides as close as possible to a leading edge of the scanning head.

4. The ejection head of claim 1, further including another wind baffle on a side of the ejection zone opposite the at least one wind baffle.

5. The ejection head of claim 4, wherein the another wind baffle and the at least one wind baffle are substantially symmetrical about the ejection zone.

6. The ejection head of claim 1, wherein the at least one wind baffle has a shape and location on the head causing air velocity in the print gap to substantially approximate a scan speed of the ejection zone in the micro-fluid ejection device during use.

7. The ejection head of claim 1, further including a plurality of wind baffles adjacent and on a same side of the ejection zone.

8. The ejection head of claim 7, wherein the plurality of wind baffles are ribs extending substantially orthogonal to a scan direction of the ejection zone in the micro-fluid ejection device during use.

9. The ejection head of claim 8, wherein the ribs are substantially parallel.

10. A micro-fluid ejection head for a micro-fluid ejection device defining a print gap from the ejection head to a print media during use, comprising:

an ejection zone defining an elevated surface of the head in a direction toward the print gap that ejects fluid across the print gap during use; and at least two wind baffles adjacent the ejection zone each on opposite sides to modify airflow in the print gap as the head reciprocates past the print media, wherein the two wind baffles have sloped leading edge surfaces.

11. The ejection head of claim 10, wherein the two wind baffles are substantially symmetrical about the ejection zone.

12. The ejection head of claim 10, wherein the two wind baffles are arranged substantially equidistant between the ejection zone and a leading edge of the reciprocating head.

13. The ejection head of claim 10, further including additional wind baffles on the opposite sides of the ejection zone to provide a cascading airflow effect to said modifying the airflow in the print gap as the head reciprocates past the print media.

14. The ejection head of claim 10, wherein the two wind baffles have a height extending from a surface of the head to the elevated surface of the ejection zone and not encroaching into a distance defining the print gap.

15. A micro-fluid ejection head for a micro-fluid ejection device defining a print gap from the ejection head to a print media during use, comprising:

an ejection zone defining an elevated surface of the head in a direction toward the print gap that ejects fluid across the print gap during use; and at least eight wind baffles symmetrically arranged adjacent the ejection zone four each on opposite sides to modify airflow in the print gap with a cascading airflow effect from one wind baffle to a next wind baffle as the head reciprocates past the print media, wherein each of the eight wind baffles have a height extending from a surface of the head to the elevated surface of the ejection zone and not encroaching into a distance defining the print gap.

16. The ejection head of claim 15, wherein the ejection zone defines an area on the elevated surface of the head, each of the wind baffles having a length orthogonal to a scan direction of the head extending beyond a boundary of the area of the ejection zone.

17. The ejection head of claim 15, wherein one of the wind baffles on either side of the ejection zone resides as close as possible to a leading edge of scanning movement.

18. A micro-fluid ejection head for a micro-fluid ejection device defining a print gap from the ejection head to a print media during use, comprising:

an ejection zone defining an elevated surface of the head in a direction toward the print gap that ejects fluid across the print gap during use; and at least two wind baffles adjacent the ejection zone each on opposite sides to modify airflow in the print gap as the head reciprocates past the print media, wherein the two wind baffles have a height extending from a surface of the head to the elevated surface of the ejection zone and not encroaching into a distance defining the print gap.

* * * * *